US007052088B2

(12) United States Patent
Aramburu Echeverria

(10) Patent No.: US 7,052,088 B2
(45) Date of Patent: May 30, 2006

(54) RECLINING CHAIR

(76) Inventor: Sebastián Aramburu Echeverria, Sueca, 51-31[a], Valencia (ES) E-46006

( * ) Notice: Subject to any disclaimer, the term of this patent is extended or adjusted under 35 U.S.C. 154(b) by 0 days.

(21) Appl. No.: 10/501,648

(22) PCT Filed: Jan. 14, 2003

(86) PCT No.: PCT/ES03/00010

§ 371 (c)(1),
(2), (4) Date: Jul. 15, 2004

(87) PCT Pub. No.: WO03/059122

PCT Pub. Date: Jul. 24, 2003

(65) Prior Publication Data

US 2005/0077769 A1 Apr. 14, 2005

(30) Foreign Application Priority Data

Jan. 18, 2002 (ES) ..... 200200164

(51) Int. Cl.
*A47C 1/02* (2006.01)

(52) U.S. Cl. ..... 297/325; 297/316; 297/DIG. 7; 297/317; 297/88

(58) Field of Classification Search ..... 297/68, 297/302.1, 300.1, 325, 316, 271.1, 423.19, 297/423.38, 88, 318, DIG. 7, 463.1
See application file for complete search history.

(56) References Cited

U.S. PATENT DOCUMENTS 2,725,921 A * 12/1955 Markin ..... 297/216.15
3,173,720 A 3/1965 Noda
3,235,304 A 2/1966 Glass
4,650,249 A * 3/1987 Serber ..... 297/313
4,678,229 A 7/1987 Ryan et al.
4,779,921 A * 10/1988 Holmstrom ..... 297/88
4,880,273 A * 11/1989 Markus ..... 297/325
5,129,701 A * 7/1992 Pine ..... 297/68
5,244,252 A * 9/1993 Serber ..... 297/216.19
5,333,368 A * 8/1994 Kriener et al. ..... 297/302.1
5,354,120 A * 10/1994 Volkle ..... 297/300.1
5,558,399 A * 9/1996 Serber ..... 297/284.4
5,603,551 A * 2/1997 Sheehan ..... 297/329
5,622,406 A * 4/1997 Meschkat et al. ..... 297/318
5,660,439 A * 8/1997 Unwalla ..... 297/316
5,735,574 A * 4/1998 Serber ..... 297/284.4
5,785,384 A * 7/1998 Sagstuen ..... 297/317
5,860,701 A * 1/1999 Jungjohann et al. ..... 297/316

(Continued)

FOREIGN PATENT DOCUMENTS

GB 213 657 4/1924

*Primary Examiner*—Anthony D. Barfield
*Assistant Examiner*—Erika Garrett
(74) *Attorney, Agent, or Firm*—Richard M Goldberg

(57) ABSTRACT

Reclining chair includes a leg (4), a seat base (3) and a backrest, with the seat base and backrest being able to be moved and tilted in respect of said leg, for maintaining the center of gravity. A tilting arrangement includes a first body (5) fitted with parallel sides (7, 8), each one of which is provided with slots (11, 12), a second body (6) fitted with parallel sides (9, 10), each of said sides being provided with slots (13, 14), and a shaft in association between each pair of slots of the first and second bodies. The reclining chair also is provided with pinion and racks associated with the shafts. The chair preferentially has a height-adjustable footrest, an also height-adjustable armrest and a tray or work surface.

11 Claims, 5 Drawing Sheets

U.S. PATENT DOCUMENTS 5,865,457 A * 2/1999 Knabusch et al. ..... 280/304.1
6,012,774 A 1/2000 Potter
6,022,071 A * 2/2000 Smith ..... 297/88
6,022,074 A * 2/2000 Swedenklef ..... 297/216.14
6,024,406 A * 2/2000 Charras et al. ..... 297/216.14
6,059,367 A * 5/2000 Rogers ..... 297/423.1
6,135,554 A 10/2000 Tsun et al.
6,450,578 B1 * 9/2002 Taggett ..... 297/325
6,578,915 B1 * 6/2003 Jonas et al. ..... 297/284.11
6,641,214 B1 * 11/2003 Veneruso ..... 297/322

* cited by examiner

RECLINING CHAIR

BACKGROUND OF THE INVENTION

This invention consists of a reclining chair for use in office or household applications which combines a simple structure, great strength, easy use and is adjustable to match the individual user.

It is desirable for an armchair to provide the greatest comfort as well as for the degree of reclining through tilting to prove satisfactory, in any event over 30/35°, so that the user's body is placed in an appropriate position.

With this aim in view, it is desirable for the armchair to have a headrest and armrests, so that the individual's comfort is independent of the position taken by the armchair, and preferably an object-carrying tray for items such as a computer keyboard, a mouse or a laptop computer.

As well as the previous items, in order for the product to be competitive on the market, it has to have a moderate price, without losing any structural strength for this reason.

A well-known type of reclining armchair has a leg on which there is a part extending forwards, articulated at its front end, so that when said articulation is released the seat tilts on the articulation shaft. This type of structure involves two main drawbacks: first of all large moments are created in respect of the support leg, which means that the structure has to be given great strength, which has a negative effect on production costs and the weight of the armchair; secondly the tilting angle is considerably limited, through requiring said articulated item to be partially concealed under the seat, and to be supported on a leg, normally fitted with wheels. Another of the disadvantages is that the centre of gravity is not significantly modified, meaning that the forces exerted by the articulation means and the support leg are greater than what is advisable.

SUMMARY OF THE INVENTION

The object of the invention now being proposed is a reclining armchair which overcomes the aforementioned drawbacks, by displacing the centre of the seat base proportionally to its tilting to maintain the position of the chair's centre of gravity with the person sitting in it, allowing more economical manufacture, maintaining or improving its structural strength, and being more versatile as regards the possible degree of tilting, with no pre-set positions.

As further advantages it has an adjustable footrest, and means to support a tray for holding for example computer devices such as a keyboard, a mouse or a portable computer.

BRIEF DESCRIPTION OF THE DRAWINGS

In order to illustrate the explanation to follow, we enclose with this descriptive report five sheets of drawings, which represent the essence of this invention in five figures, and in which.

DETAILED DESCRIPTION

Figure 1:
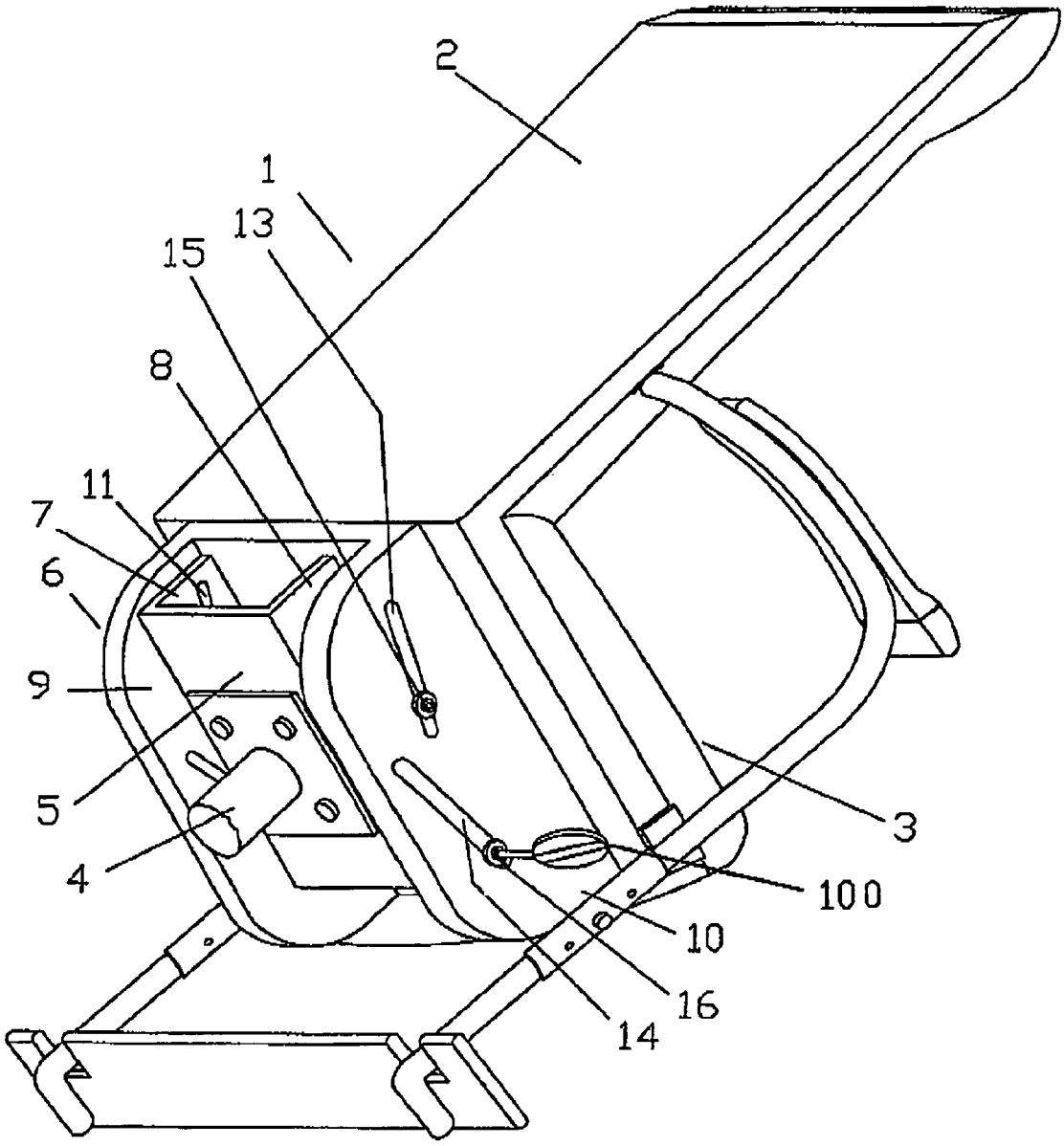
FIG. 1 shows the armchair of the invention seen from the bottom, in which the support has been removed to make the drawing clearer.
Figure 2:
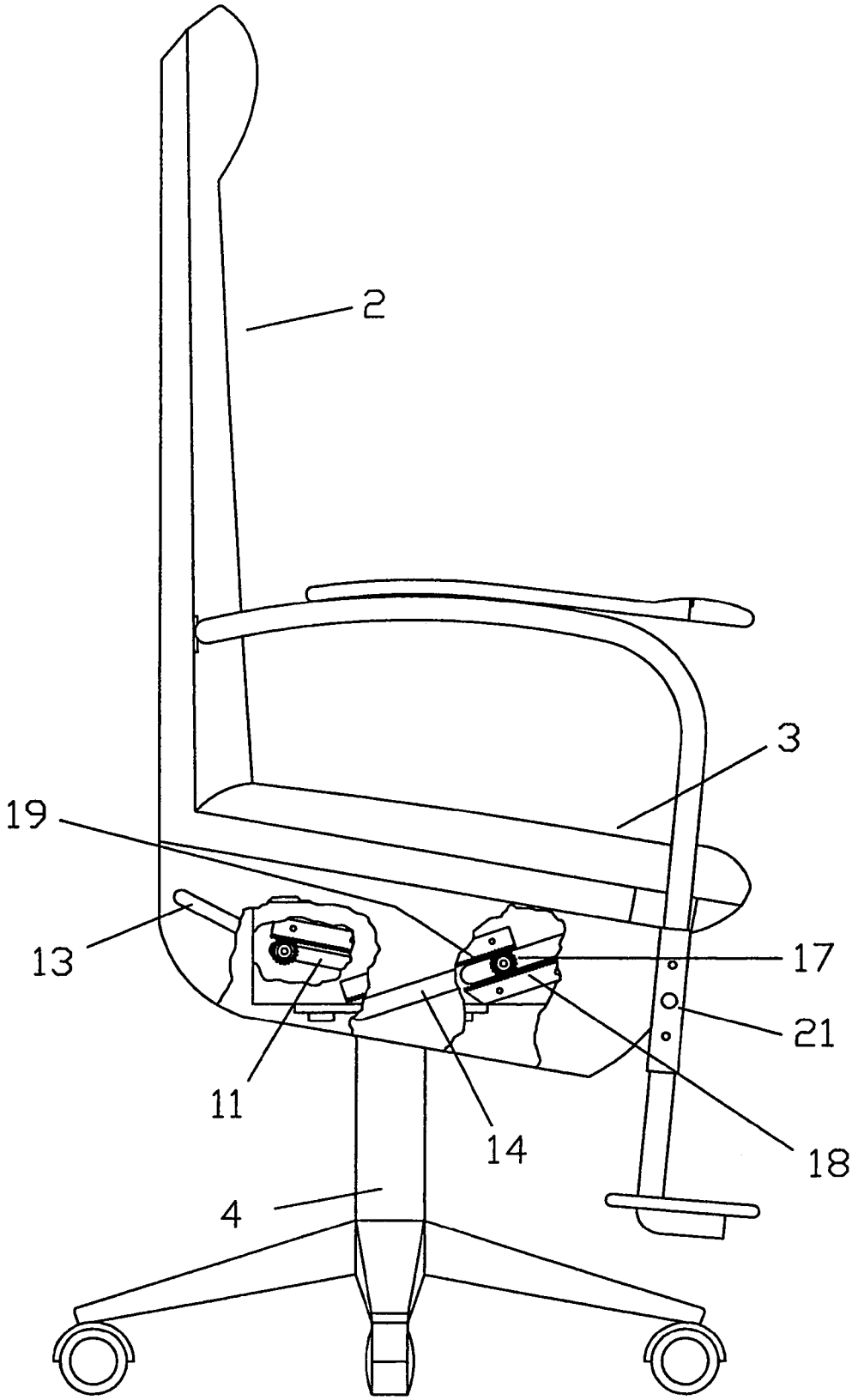
FIG. 2 shows the armchair of the invention from a side view in which the base has been made with a cutaway to illustrate the interior mechanism.
Figure 3:
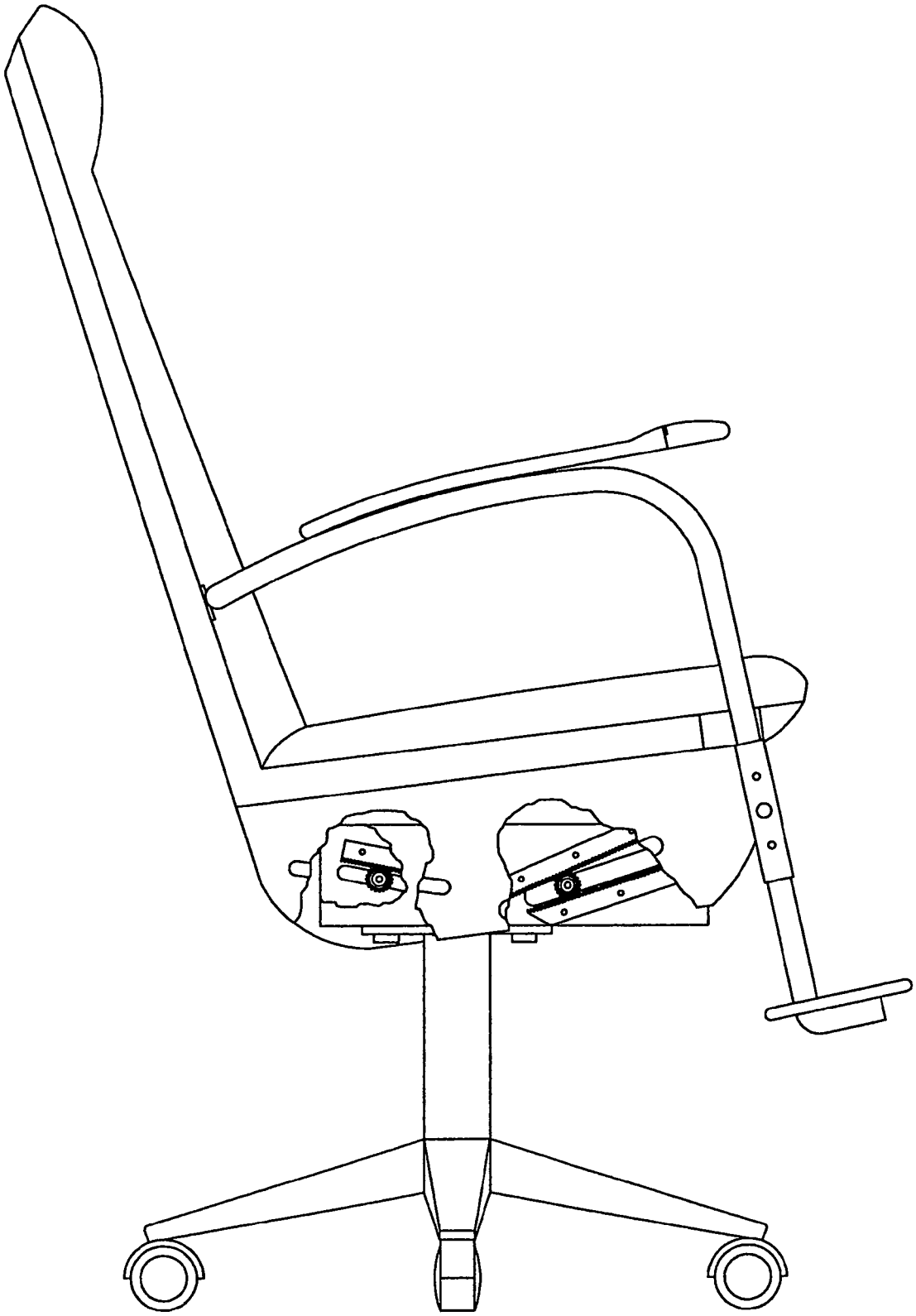
FIG. 3 shows the armchair of the invention in a slightly tilted position in which, in the cutaway made, the position of the mechanism can be seen.
Figure 4:
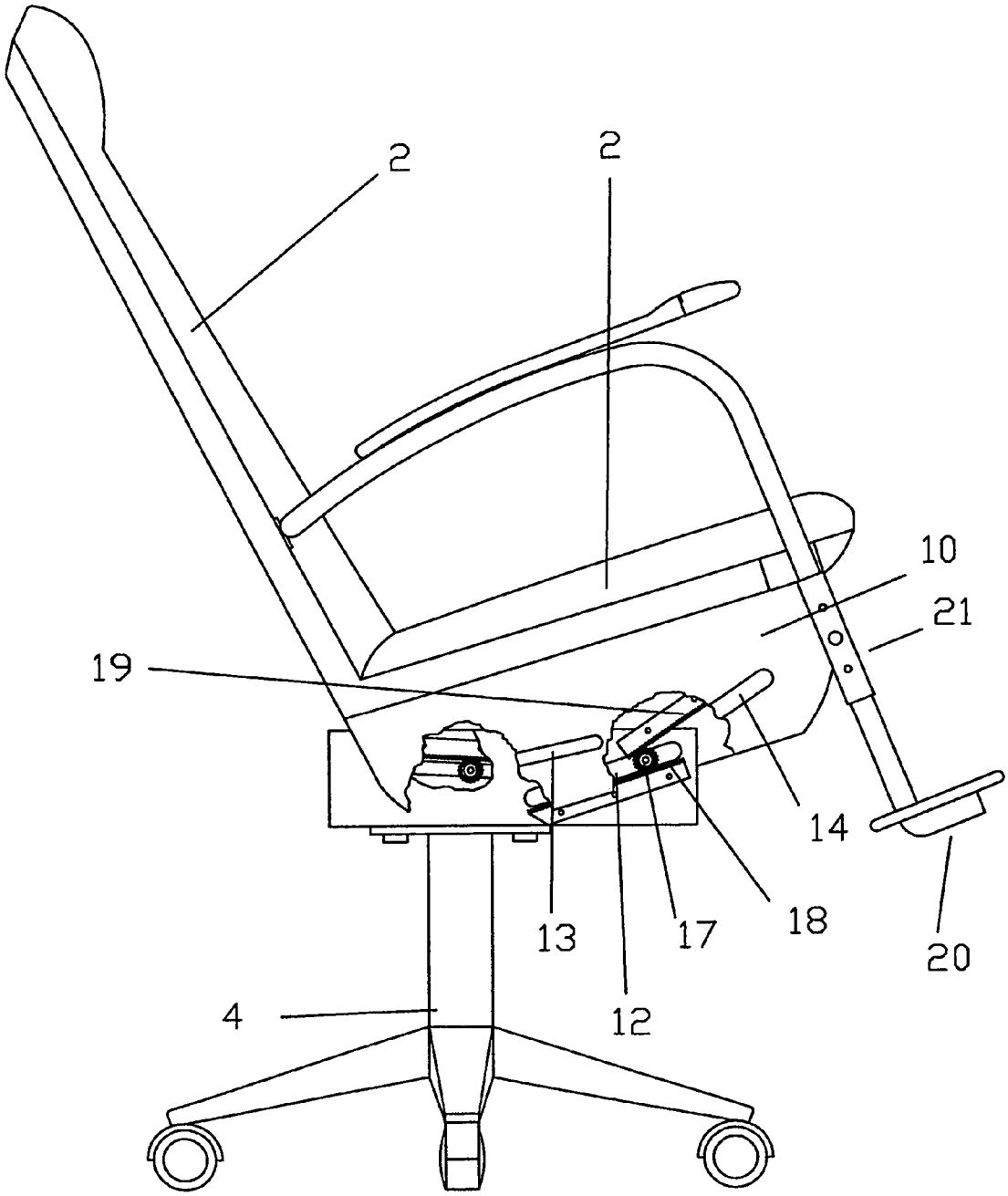
FIG. 4 shows a view similar to that of FIG. 3 but in a totally tilted position.
Figure 5:
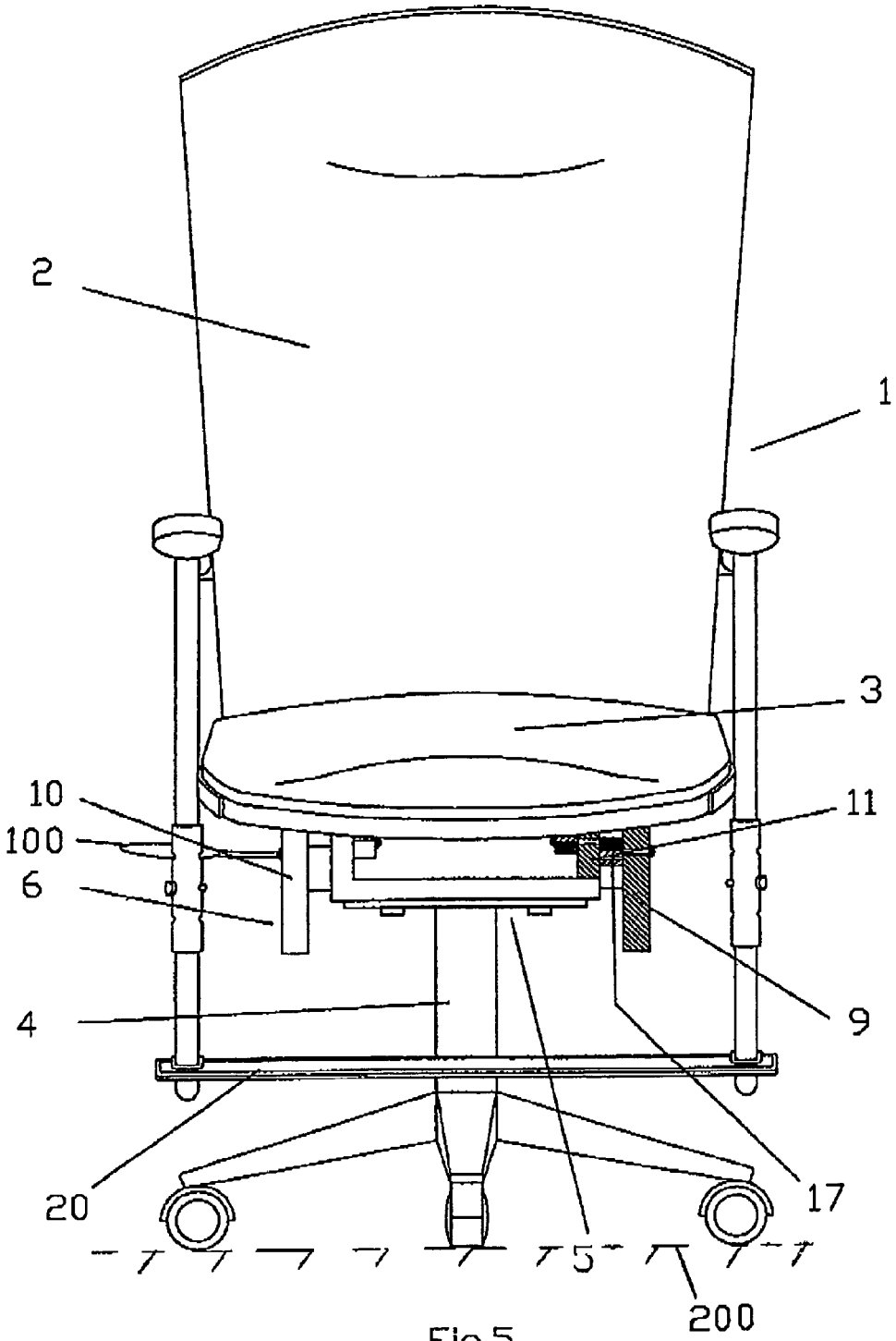
FIG. 5 shows a front view of the armchair in which the tilting mechanism is appreciated.

In these FIG. 1 represents the armchair covered by this invention, fitted with a backrest 2 and a seat base 3. The preferential angle of the base plane of the backrest in respect of the base plane of the seat is 100°.

4 shows a support leg for the armchair over, for example, a base fitted with wheels which is supported on a ground surface 200. It is advisable for the support leg to have height adjustment means, such as an elastic and/or pneumatic system, as already known in the state of the art, or any other mechanical media, which in any event are outside the scope of this invention.

The support leg 4 of the armchair 1 is securely joined to a first body 5 mobile in respect of a second body 6 secured to the base of the armchair 1. Both the first body 5 and the second body 6 have at least two lateral surfaces 7 and 8 and 9 and 10, respectively, each fitted with at least one pair of slots 11 and 12 and 13 and 14 respectively. These slots are crossed by two shafts 15 and 16. At this point we should state that the shaft can be mechanically common to both sides of the mechanisms or be formed of two separate mechanical shafts constituting a single geometrical shaft, so we will refer to the mechanical shaft on both as a single shaft, even though it could be divided into two parts. At least one of these shafts 15 or 16 is fitted with a pinion 17 engaging on one side with a rack 18 joined to one of the slots 11 or 12 and on the other side to another rack 19 connected to slots 13 or 14.

The armchair body 1 can then be displaced from a non-tilted end position to a tilted position, involving the movement of the set of items 1, 2, 3, 6, 9, 10, 13, 14 and in particular that of the rack 18 which will force the corresponding movement of the pinion 17, with which it takes on a precise position defined through the effects of the other rack 19 of the set of elements secured to the base 4, 5, 7, 8, 11, 12, 19.

Through the convergence of the slots 11, 12, 13, 14 the sliding movement produces in turn a rotation, since all the other degrees of freedom of the mechanism are restricted by this position. The sliding will be limited by the position of the shafts in the determined position of slots 11 and 13 or 12 and 14, which will never be parallel and the rotation will be limited by the existence of the pair of shafts 15 and 16 themselves, one in each pair of slots 11 and 13, or 12 and 14.

Though it may prove useful to give both pairs of slots 11 and 13 and 12 and 14 their own rack assembly 17, 18 and 19, for the sake of operating smoothness and precision, it is also possible to build the chair with a single rack leaving the other shaft 15 or 16 free.

Given that people's height is not always the same, it is also recommendable and intended in this invention to provide the armrests with height adjustment.

Another optional characteristic is to give the armchair 1 a support tray or work surface set between the armrests, for example tilting to one side, on which work or leisure items can be placed, such as computer accessories (keyboard, mouse, laptop computer or a book or games). To prevent any such articles from falling off, it is intended for this tray to be fitted with the securing or housing means with a rim for preventing the articles from falling. The examples given are obviously not limiting.

According to one form of embodiment, the seat is tilted by moving a lever 100 set on one of its sides, so that the pinions are moved in respect of the racks by means of the proper reduction.

In a more sophisticated embodiment, the movement can be driven by means of an electric motor.

It has been envisaged for the relative displacement between the racks to be done only by one of the shafts 15 or 16. In this case the second shaft will remain at the proper distance in respect of the first by means of at least one separating rod or shaft.

This is for industrial application in the manufacture of seating.

The invention claimed is:

1. Reclining armchair, comprising:

a seat, a backrest secured to said seat, a support leg for supporting said seat and said backrest on a ground surface, and an arrangement for tilting said seat to a relaxation position, said arrangement including:

a first body joined to the support leg, said first body having two sides parallel with each other, each of said parallel sides having at least two slots therein, said slots not being parallel with each other;

a second body joined to the seat and backrest of the armchair, said second body having two sides parallel with each other and parallel with the parallel sides of the first body, each of said parallel sides of said second body having at least two slots which are not parallel with each other;

the slots of the first body being in at least partial alignment with the slots of the second body;

a shaft crossing each pair of aligned slots of the first and second bodies; and the at least two slots in the first body being oriented relative to each other and the at least two slots in the second body being oriented relative to each other in a manner to provide that the seat maintains a position of a center of gravity during articulation movement of the seat in respect of the support leg.

2. Reclining armchair, according to claim 1, further comprising:

at least one rack associated with each pair of slots and the shaft associated with the slots, and a pinion securely joined to each said shaft and engaged with said at least one rack for determining a position of the shaft fitted with the pinion, the relative position of displacement and rotation of the slots with respect to each other and consequently of the seat in respect of the supporting leg.

3. Reclining chair, according to claim 1, wherein the two pairs of slots are fitted with a corresponding rack and linked by a respective said shaft fitted with a corresponding pinion.

4. Reclining armchair, according to claim 1, further comprising a footrest secured to said seat, said footrest being one of:

height-adjustable, and not height-adjustable.

5. Reclining armchair, according to claim 1, further comprising height-adjustable armrests secured to at least one of the seat and the backrest.

6. Reclining armchair, according to claim 1, further comprising a lever for operating the reclining movement.

7. Reclining armchair, according to claim 1, wherein the shafts which are movable, are kept at a fixed distance relative to each other, by at least one rod connecting the shafts.

8. Reclining armchair, according to claim 1, wherein said support leg is one of:

a) height-adjustable, and b) not height-adjustable.

9. Reclining armchair, according to claim 1, wherein the at least two slots in the first body include two slots which angle downwardly in a direction toward each other, and the at least two slots in the second body include two slots which angle downwardly in a direction toward each other.

10. Reclining armchair, according to claim 1, wherein the slots in the first body do not overlap, as viewed in a transverse direction of the armchair, and the slots in the second body do not overlap, as viewed in a transverse direction of the armchair.

11. Reclining armchair, according to claim 1, wherein the slots in the first and second bodies extend in a substantially linear direction.

* * * * *